US008904816B2

(12) United States Patent
Bergqvist et al.

(10) Patent No.: US 8,904,816 B2
(45) Date of Patent: Dec. 9, 2014

(54) ICE MAKER AND METHOD OF PRODUCING PIECES OF ICE

(75) Inventors: Anders Bergqvist, Solna (SE); Per Wedby, Sundbyberg (SE); Björn Flemsäter, Lidingö (SE); Jan Rickman, Djurshamn (SE); Ingemar Hallin, Lidingö (SE)

(73) Assignee: Dometic Sweden AB, Solna (SE)

( * ) Notice: Subject to any disclaimer, the term of this patent is extended or adjusted under 35 U.S.C. 154(b) by 253 days.

(21) Appl. No.: 13/146,455

(22) PCT Filed: Feb. 9, 2010

(86) PCT No.: PCT/EP2010/051546
§ 371 (c)(1),
(2), (4) Date: Aug. 18, 2011

(87) PCT Pub. No.: WO2010/089406
PCT Pub. Date: Aug. 12, 2010

(65) Prior Publication Data

US 2011/0296863 A1 Dec. 8, 2011

(30) Foreign Application Priority Data

Feb. 9, 2009 (EP) ..... 09152386

(51) Int. Cl.

| | |
|---|---|
| ***A23G 9/00*** | (2006.01) |
| ***F25C 1/10*** | (2006.01) |
| *F25C 1/24* | (2006.01) |
| *F25C 5/06* | (2006.01) |

(52) U.S. Cl.
CPC . *F25C 1/10* (2013.01); *F25C 1/243* (2013.01); *F25C 2305/022* (2013.01); *F25C 5/06* (2013.01)
USPC ..... 62/345; 62/63; 62/66; 62/72; 62/380

(58) Field of Classification Search
USPC ..... 62/74, 340, 63, 66, 71, 72, 345, 347, 62/380, 344; 249/203
See application file for complete search history.

(56) References Cited

U.S. PATENT DOCUMENTS 1,858,558 A * 5/1932 Reeves ..... 249/131
2,510,400 A 6/1950 Hurley (Continued)

FOREIGN PATENT DOCUMENTS

CN 1479063 A 3/2004
DE 1922920 A 9/1965

(Continued)

OTHER PUBLICATIONS

European Search Report for Application No. EP03256665 dated Mar. 18, 2004.

(Continued)

*Primary Examiner* — Allana Lewin
*Assistant Examiner* — Raheena Rehman
(74) *Attorney, Agent, or Firm* — Pearne & Gordon LLP

(57) ABSTRACT

Ice maker comprising a mould (10, 110) forming at a number of mould cavities (11, 111*a*, 11*b*) for receiving water and forming a respective piece of ice (41, 42,141), which number of mould cavities are arranged in at least one column defining a longitudinal direction; a first (2, 102) and a second shaft (3, 103); an endless conveyor (100), which is arranged to convey the mould in the longitudinal direction around at least the first shaft; and drive means (8) connected to at least one of the first and second shafts for driving the conveyor. The mould (10, 110) is formed of an elastic material and arranged to be elastically deformed as the mould passes over the first shaft (2, 102). Longitudinal communication channels (13*a*, 113*a*) are arranged between consecutive mould cavities (11, 111*a*) arranged in one column, for allowing water to flow between mould cavities in one column. A method of fabricating pieces of ice is also disclosed.

18 Claims, 4 Drawing Sheets

(56) References Cited

U.S. PATENT DOCUMENTS

| | | | | | |
|---|---|---|---|---|---|
| 2,990,697 | A | | 7/1961 | Buzicky | |
| 3,146,601 | A | | 9/1964 | Gould | |
| 3,192,726 | A | | 7/1965 | Newton | |
| 3,199,309 | A | * | 8/1965 | Brubuker | 62/345 |
| 3,247,682 | A | | 4/1966 | Jacobs | |
| 3,253,425 | A | | 5/1966 | McKissick | |
| 3,264,844 | A | | 8/1966 | Kesling | |
| 3,285,029 | A | * | 11/1966 | Pansing | 62/135 |
| 3,309,892 | A | * | 3/1967 | O'Connell et al. | 62/345 |
| 3,449,921 | A | * | 6/1969 | Connors | 62/137 |
| 3,529,430 | A | * | 9/1970 | Bauerlein | 62/137 |
| 3,563,050 | A | * | 2/1971 | Fox | 62/233 |
| 3,580,007 | A | * | 5/1971 | Bauerlein | 62/345 |
| 3,596,477 | A | * | 8/1971 | Harley | 62/353 |
| 4,487,024 | A | | 12/1984 | Fletcher et al. | |
| 5,140,831 | A | | 8/1992 | Kohl et al. | |
| 6,349,550 | B1 | * | 2/2002 | Shapiro et al. | 62/72 |
| 6,357,720 | B1 | | 3/2002 | Shapiro et al. | |
| 6,438,976 | B2 | * | 8/2002 | Shapiro et al. | 62/135 |
| 6,792,770 | B2 | | 9/2004 | Hwang | |
| 2001/0027654 | A1 | | 10/2001 | Shapiro et al. | |
| 2007/0107447 | A1 | * | 5/2007 | Langlotz | 62/66 |

FOREIGN PATENT DOCUMENTS

| | | | | |
|---|---|---|---|---|
| EP | 1441188 | A1 | | 7/2004 |
| JP | 2000088414 | A | * | 3/2000 |

OTHER PUBLICATIONS

Search Report from State Intellectual Property of China for Application No. 201080006773.0 dated Dec. 4, 2012.

International Search Report for PCT/EP2010/051546 dated Feb. 9, 2011.

* cited by examiner

ICE MAKER AND METHOD OF PRODUCING PIECES OF ICE

FIELD OF THE INVENTION

The invention relates to an ice maker for producing and harvesting pieces of ice in a refrigerator. The invention also relates to a method of producing and harvesting pieces of ice by means of such an ice maker.

BACKGROUND AND PRIOR ART

Modern refrigerators may be provided with an ice maker for producing pieces of ice, normally in the form of ice cubes. The ice maker may typically be arranged in a freezer cabinet or in the freezer compartment of a double compartment refrigerator cabinet. The ice maker normally comprises a mould or a tray forming a plurality of mould cavities for receiving water and forming ice cubes when the water is freezing in the respective cavities. The ice maker may be manually operated, in which case the user manually supplies water to the mould and manually releases the pieces of ice from the mould. The ice maker may alternatively be semi or fully automatic, such that the supply of water and/or the harvesting of pieces of ice is made automatically. Upon harvesting, the pieces of ice may be collected in a storage container inside the refrigerator. There may also be provided a dispensing means for dispensing pieces of ice through the refrigerator door, so that the ice is made available from the outside of the refrigerator.

A general problem at ice makers is that the pieces of ice adheres to the walls of the mould cavities upon freezing of the water. Harvesting and especially automatic harvesting is thereby made difficult. In the prior art, different ways of overcoming this problem in order to accomplish automatic harvesting has been suggested.

One previously known automatic ice maker comprises a rigid ice tray of a metallic material, forming an array of mould cavities and a water supply conduit for supplying water to the cavities. The ice maker further comprises heating means for heating the tray and a set of mechanically movable fingers which are arranged to be movable in a respective cavity. At harvesting, the tray is first heated such that the mould wall contacting surfaces of the pieces of ice are melted in order to release the pieces of ice from the walls. The fingers are thereafter operated to push the pieces of ice out of the respective cavities, over the upper edge of the tray, such that they fall down to a storage container arranged below the tray.

A problem at this known device is that the harvesting requires heating of the ice. Such heating is naturally disadvantageous in regard of the overall energy consumption of the ice making process. Further more, the heating adversely influences the cooling capacity of the refrigerator in which the ice maker is arranged. This problem is especially severe at absorption refrigerators where the total cooling capacity is limited. A further problem at this known device is that the pieces of ice, upon harvesting, are spread over a comparatively large area, which corresponds to the total length of the tray. This in turn makes the use of a correspondingly large collecting area of the storage container necessary.

Another previously known ice maker comprises a tray made of a somewhat flexible plastic material. The tray forms a matrix of e.g. two or three columns with approximately ten rows of mould cavities. The tray is arranged rotatable about a longitudinal axis, which is parallel to the cavity columns. A rotation stop is arranged at one corner of the tray, such that the tray may be freely rotated approximately 180° from a starting position, in which the mould cavities are facing upwards. A drive means for rotating the tray is connected to the short side being distal from said corner. Water is supplied to the cavities when the tray is in the starting position. When freezing of the water is competed the drive means is operated to rotate the tray until it is turned upside down and said corner contacts the stop. The drive means then continues to apply a rotational force onto the short side being distal from said corner. Hereby the tray is twisted such that a torsional deformation is created whereby the walls of each cavity also are deformed. The cavity wall deformation squeezes the pieces of ices such that they are released from the cavity walls and fall down into a storage container, which is arranged below the tray.

This known devices has the advantage of not requiring heating. However, certain problems still remain. Repeated operation may for instance cause fatigue fracture of the tray. The comparatively small deformation of the cavity walls, especially at the ends of the tray further makes release of pieces of ice from these cavities uncertain. Also at this known device, the pieces of ice released from the tray are spread over a comparatively large area, which area corresponds to the area of the tray and which requires a comparatively large collecting area of the storage container.

EP 1 441 188 A1 describes a further known ice maker. This ice maker comprises a number of metallic tray cells which are linked together to form a closed curve conveyor. The conveyor is arranged movable around a pair of pulleys. A cooling and heating apparatus in the form of a Peltier element is arranged between the pulleys. The Peltier element is arranged to cool tray cells positioned above it and to heat tray cells positioned below it. In use, water is supplied to tray cells facing upwards and positioned above the Peltier element. The Peltier element absorbs heat from these upper tray cells to thereby accelerate the production of ice. When the water in the upper tray cells is frozen the pulleys are rotated to thereby move the upper tray cells such that they are positioned below the Peltier element and facing downwards. In this position the Peltier element radiates heat to the now lower tray cells, whereby the pieces of ice in these cells begin to melt. Thereby these pieces of ice are released from the lower tray cells and fall down into a storage tray arranged below the conveyor. A problem with this ice maker is that it requires additional energy for supplying power to the Peltier element. The heating of the lower tray cells also adversely effects the cooling capacity of the entire refrigerator in which the ice maker is arranged. Also at this ice maker, the pieces of ice released from the lower tray cells are spread over a comparatively large area, which area corresponds to the projected area of the conveyor and which requires a comparatively large collecting area of the storage container.

US 2001/0027654 A1 discloses an ice maker assembly disposed within a refrigerator having a freezer and a fresh food compartment. The ice maker assembly comprises a conveyor positioned within the freezer compartment having a flexible conveyor belt with a multiplicity of individual ice cube moulds for creation of individual ice cubes.

SUMMARY OF THE INVENTION

It is an object of the present invention to provide an improved ice maker. Another object is to provide an ice maker which is reliable in use and energy efficient. A further object is to provide an ice maker which does not require heating for harvesting and which still ensures full release of pieces of ice with a high degree of certainty. A still further object is to provide an ice maker which allows great flexibility in regard of the arrangement of cavities for forming ice cubes and in regard of the overall dimensions of the ice maker. Yet another object is to provide an ice maker at which the pieces of ice, upon harvesting may be collected at a well defined and comparatively small area.

These and other objects are achieved by an ice maker according to the preamble of claim 1, which exhibits the special technical features set out in the characterizing portion of the claim. The ice maker according to the invention comprises a mould forming a number of mould cavities for receiving water and for forming a respective piece of ice, which number of mould cavities are arranged in at least one column defining a longitudinal direction; a first and a second shaft; an endless conveyor, which is arranged to convey the mould in the longitudinal direction around at least the first shaft; and drive means connected to at least one of the first and second shafts for driving the conveyor. The mould is formed of an elastic material and arranged to be deformed elastically as the mould passes over at least the first shaft. The ice maker further comprises longitudinal communication channels which are arranged between consecutive mould cavities arranged in one column, for allowing water to flow between mould cavities in one column.

With the ice maker according to the invention, water may be supplied to the mould cavities when these are positioned in an upper position and facing upwardly. The mould cavities supplied with water are maintained in an upwardly facing position until the water is frozen completely. This may be done either by keeping the conveyor stationary or by moving the conveyor slowly, such that water in a number of mould cavities has frozen completely when these cavities reach the first shaft, at which the cavities are transitioned from the upwardly facing to the downwardly facing position.

The piece of ice in a certain mould cavity is harvested by actuating the drive means to drive the conveyor until the cavity has passed over the first shaft at which the cavity is transitioned from the upwardly facing position to the downwardly facing position. When passing over the first shaft, the elastic lateral mould walls surrounding the cavity are deformed such that the respective lateral walls of the piece of ice are released from the lateral walls of the cavity. At the same time the elastic bottom mould wall of the cavity will follow the curvature of the shaft such that it is gradually bent away from the bottom of the piece of ice. Hereby, at least a major part of the bottom surface of the piece of ice is released from the bottom wall of the cavity. Under the influence of gravity, the piece of ice may thereby be completely released from the mould cavity walls and fall down from the region of the shaft.

The longitudinal communication channels arranged between consecutive cavities in one column result in a number of advantages. The channels allow for that several cavities maybe simultaneously filled with water by supplying water from a feed pipe or the like into a single cavity. Since, by this means, a larger volume of water is supplied at each supply operation, the accuracy by which the supplied volume has to be measured may be decreased. This in turn puts lower requirements on and reduces the costs of the means for controlling water supply. The channels also lead to that bridges of ice are formed between consecutive ice cubes, when the water in the cavities and in the channels is frozen. Such bridges of ice assist in releasing pieces of ice from the mould upon harvesting. When a first mould cavity reaches the first shaft, the ice bridge linking the corresponding piece of ice to the piece of ice in the consecutively following mould cavity, will contribute to maintaining the first piece of ice at the same horizontal level as the following mould cavity. Thereby the first piece of ice will be maintained at a higher level as its mould cavity is directed downwards along the periphery of the first shaft. Such maintaining of the first piece of ice thus assists in fully separating the piece of ice 10 from all of the walls defining its mould cavity. The longitudinal communication channels further allow that the above mentioned advantages of simultaneous filling of several cavities may be achieved also at ice makers comprising a single column of several mould cavities arranged consecutively one after the other in the longitudinal direction. This in turn provides a great flexibility in possible ways of arranging the mould cavities and thereby in choosing the overall dimensions of the ice maker. The inventive ice maker may e.g. be provided with a single column mould, which allows that the lateral width of the ice maker is kept at a minimum.

With the ice maker according to the invention, complete release of the piece of ice is accomplished in a simple and reliable manner. The release of pieces of ice does not require any heating what so ever of the mould or the piece of ice. A further advantage is that the pieces of ice will be released from the mould at a comparatively small and well-defined area. The collecting opening of and possibly the entire storage container for the pieces of ice may thereby be kept small, which reduces the overall space requirements. The well-defined and small release area further facilitates e.g. delivery of the released pieces of ice directly into an ice dispensing means which may be arranged in a front door of the refrigerator in which the ice maker is arranged.

The elastic deformation of the cavity walls may involve stretching, compression, bending and/or wrinkling or any other type of elastic deformation of the material forming the cavity walls. Such deformation creates a relative movement between the surfaces of the rigid piece of ice and the corresponding cavity walls, which relative movement contributes to the release of the piece of ice from the cavity walls. The deformation may also result in that a portion or one or several entire walls are moved away from the respective surface of the piece of ice. In such case the piece of ice is released by actually eliminating contact between corresponding portions of pieces of ice and the cavity walls.

If desired, the mould may comprise at least two columns of mould cavities. At such embodiments lateral communication channels are preferably arranged generally perpendicular to the longitudinal direction between adjacent mould cavities in respective columns. Hereby an even grater volume of water may be supplied simultaneously, whereby the control of the amount of water supplied in one supply operation is facilitated further.

The first shaft, the conveyor and the mould may be arranged to compress walls of the mould cavity elastically, as the mould cavity passes over the first shaft. At such an embodiment the deformation of the cavity walls may be rather small while still achieving a complete release between the walls of the cavity and the piece of ice.

The first shaft, the conveyor and the mould may also or instead be arranged to stretch one or several walls of the mould cavity, as the mould cavity passes over the first shaft.

For example, the leading and the hindmost walls of a cavity may be stretched away from each other to thereby release the corresponding walls of the piece of ice from these cavity walls. At the same time the side walls, which may be arranged perpendicular to the leading and hindmost walls, may be compressed when passing over the first shaft.

The mould and conveyor belt may be formed as separate units which are fixed to each other. In this way the conveyor belt and the mould may readily be manufactured of different materials having properties suitable for their respective purposes. E.g. the conveyor belt may be manufactured from a cord reinforced material having small longitudinal elasticity and the mould may be formed of a material having great elasticity in all directions. The two materials are then easily combined by fixing them together.

Alternatively, the mould and the conveyor belt may be formed as an integral unit. This reduces the total number of parts making up the ice maker to thereby constitute a cost saving solution. It may also contribute to ensure that the conveyor belt and mould are kept united to thereby increase the service life of the arrangement.

The mould may extend over approximately half of the circumferential length of the conveyor. By this means batchwise production of pieces of ice is facilitated.

At such an embodiment, longitudinal channels and, if the mould comprises more than one column of cavities, lateral channels may be arranged between all mould cavities of the mould. This arrangement provides for that all cavities may be simultaneously positioned between the two shafts and facing upwardly. All cavities may thereby be supplied with water simultaneously. At harvesting, the drive means may then be activated to rotate the conveyor a complete round, such that all cavities passes the shaft where the pieces of ice are released to thereafter pass also the second shaft and to return to the upwardly facing position, where they may again be supplied with water. Such batchwise production simplifies e.g. the control of the drive means.

The mould may alternatively extend over approximately the entire circumferential length of the conveyor. At such an embodiment first longitudinal communication channels are arranged between consecutive mould cavities of a first set of mould cavities, which first set of mould cavities are arranged in at least one column and extend over approximately a first half of the circumferential length of the conveyor. At such an arrangement the first set of mould cavities may be used for batchwise production of ice whereas the remaining mould cavities may be used for semi-continuous or stepwise manufacturing and harvesting of pieces of ice. The mould may for instance comprises a matrix of two columns of cavities which columns extend over the entire length of the conveyor to thereby form an endless mould with cavities arranged side by side in pairs. The first set of mould cavities extending over the first half of the conveyor and having longitudinal communication channels are supplied with water and harvested batchwise as described above. For supplying water to and harvesting the remaining mould cavities, the conveyor may be driven continuously at a low speed. The speed of the conveyor is set such that the time required for a pair of remaining cavities to travel from the shaft at which the cavities are transitioned from the downwardly facing to the upwardly facing position to the other shaft corresponds to the time required for complete freezing of the water in this pair of cavities. Water is supplied to the pair of cavities which have just recently been transitioned to the upwardly facing position. In order to facilitate supply of a correct amount of water, a lateral communication channel may be formed between the cavities in each pair. As the pair of cavities, in the upwardly facing position, travels from the water supply position to the shaft at which the cavities are transitioned to the downwardly facing position, the water in these cavities are completely frozen to form solid pieces of ice. When the pair of cavities reaches the shaft at which they are transitioned to the downwardly facing position, the two pieces of ice are released from the mould as described above. This arrangement permits the use of a comparatively simple control of the drive means for driving the conveyor and provides for a partial semi-continuous production of ice in an efficient manner.

Instead of utilizing the above mentioned remaining mould cavities for stepwise or semi-continuous production, second longitudinal communication channels may be arranged between consecutive mould cavities of a second set of mould cavities, which second set of mould cavities are arranged in at least one column and extend over approximately a second half of the circumferential length of the conveyor and wherein the first set of mould cavities do not communicate with the second set of mould cavities. This allows for that two batches of pieces of ice may be produced at one revolution of the conveyor.

The ice maker may advantageously comprise ice breaking means arranged to break an ice bridge formed between two consecutive pieces of ice when the corresponding mould cavities passes over the first shaft. By this means, ice bridges formed by longitudinal communicating channels arranged between two or a plurality of cavities may be readily broken. Thereby ice is delivered as separate pieces of ice having generally the form defined by the respective mould cavity.

The ice maker may comprise a housing inside of which the conveyor, the first and second shaft and the mould are arranged. This facilitates the maintaining of a predetermined temperature suitable for the manufacturing of ice also when the ice maker is arranged in a refrigerator compartment which should be maintained at another temperature.

The ice breaking means may then comprise a wall of the housing which is arranged at a predetermined distance from the first shaft for breaking an ice bridge formed between two consecutive pieces of ice when the corresponding mould cavities passes over the first shaft. By this means a simple and space saving arrangement which contributes to the delivery of separate pieces of ice is achieved.

The ice maker may comprise means for providing cool air into the housing. This further facilitates the possibility to create and maintain a suitable temperature for the ice manufacturing process.

The conveyor may comprise a conveyor belt formed of a first material and a mould formed of a second material, which first material is substantially more rigid than the second material. In this way a secure drive of the conveyor by means of the drive means and the drive shaft or shafts without slipping of the conveyor belt is accomplished. At the same time the mould may be formed of any material having appropriate elastic characteristics at the operating temperatures, which normally is between 0° and −20° C.

The drive means may comprise an electric motor. By this means automatic harvesting of the pieces of ice may easily be accomplished. However, in cases where manual harvesting is preferred, the drive means may instead comprise a manually operable organ, such as a rotatable knob or crank or the like.

The ice maker may be arranged in a refrigerator cabinet comprising a door. The shaft at which the pieces of ice are released from the mould may then be arranged in proximity to or inside the door, when the door is in a closed position. By this means, dispensing of the pieces of ice trough the door to the outside of the refrigerator is made possible, in a space saving manner.

The invention also concerns a method of fabricating pieces of ice as set out in the appended claim 18. The method achieves objectives and exhibits advantages corresponding to those described above in regard of the ice maker.

BRIEF DESCRIPTION OF THE DRAWINGS

In the following an exemplifying detailed description of embodiments will be given with reference to the figures in which.

DETAILED DESCRIPTION OF EMBODIMENTS

Figure 1:
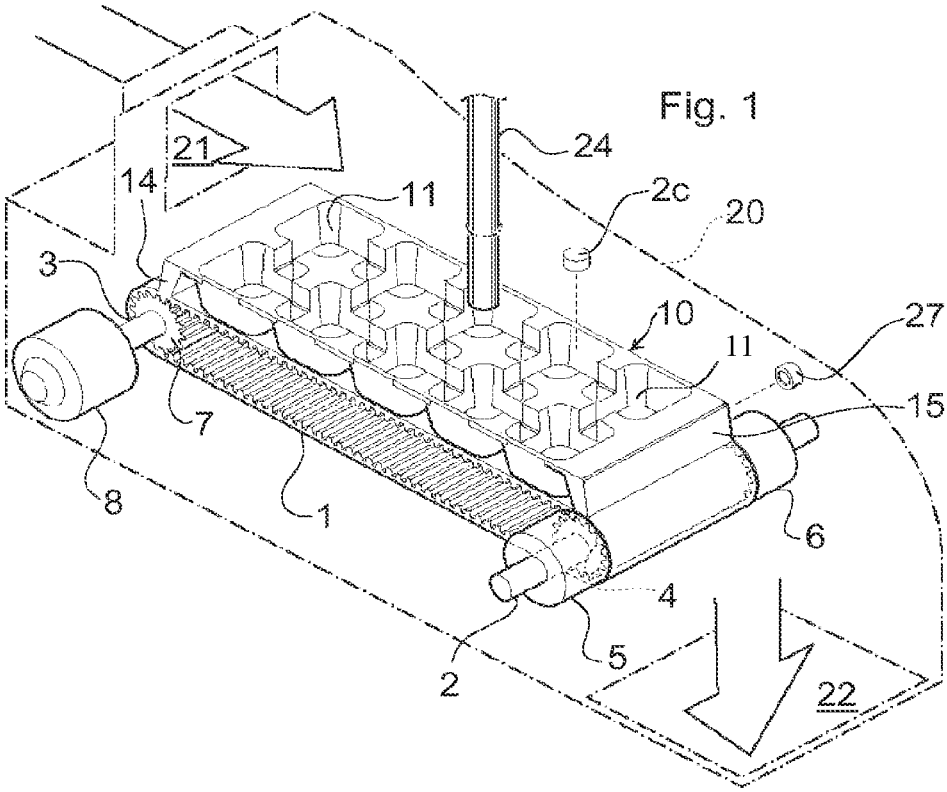
FIG. 1 is a schematic perspective view of an ice maker according to an embodiment of the invention, where some parts are illustrated transparent and showing the ice maker in a first position.

The ice maker illustrated in the FIGS. 1-6 comprises an endless conveyor belt 1 which is arranged around a first 2 and a second 3 shaft. The first shaft 2 is provided with a longitudinally splined roller 4 and side rollers 5, 6 which are arranged coaxially outside of a respective end of the splined roller 4. The side rollers 5, 6 have essentially smooth envelope surfaces. The second shaft 3 is provided with a pulley 7 in the form of a splined roller. An electric motor 8 is connected to the second shaft for driving the pulley 7. The motor is electrically connected to a control unit (not shown) for controlling the operation of the motor and thereby the drive of the pulley 7. The conveyor belt 1 is, at the surface facing the splined roller 4 and the pulley 7, provided with transverse ribs. The ribs mate with the splines of the pulley 7 and the roller 4 for providing a secure, slip free and uniform drive of the conveyor belt 1. The conveyor belt is formed of a flexible, essentially non-elastic material. At the ice maker illustrated in the figures, the conveyor belt 1 is made of cord reinforced silicone rubber. Other suitable materials for forming the conveyor belt are natural rubber and polyurethane resin.

A mould 10 is formed as an integral unit of a material which is elastically deformable at temperatures below 0° C. and down to at least about −20° C. In the exemplifying embodiment shown, the mould 10 is formed of silicone, which has excellent elastic characteristics and which is also suitable and approved for being used at food handling applications. The mould may however also be formed of other elastic materials.

The mould 10 comprises a plurality of mould cavities 11 and is attached to the conveyor belt 1, on the surface facing away from the first 2 and second 3 shafts. In the exemplifying embodiment illustrated in the figures, the mould comprises a matrix having ten mould cavities 11. The matrix is formed of two columns, each column defining a longitudinal direction, extending in parallel with the direction of movement of the conveyor belt 1 and five transversely arranged rows of mould cavities 11.

Figure 3:
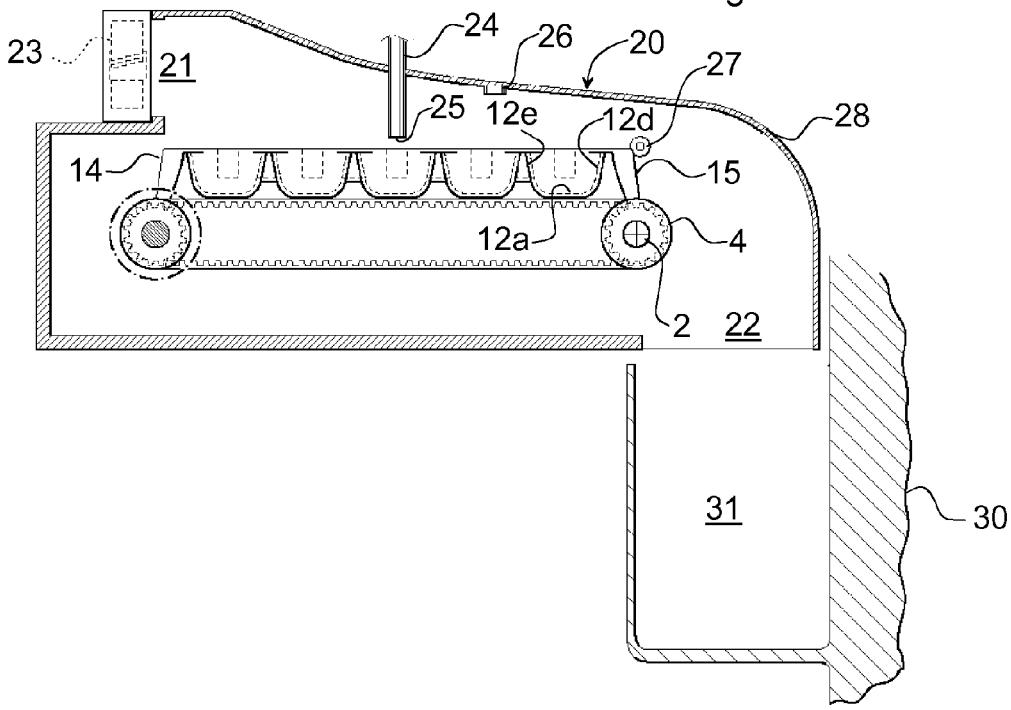
FIG. 3-5 are side views of the ice maker shown in FIG. 1 when the ice maker is in respective positions during manufacturing and harvesting of ice. The figures further illustrates pieces of ice and a front door of a refrigerator cabinet.
Figure 6:
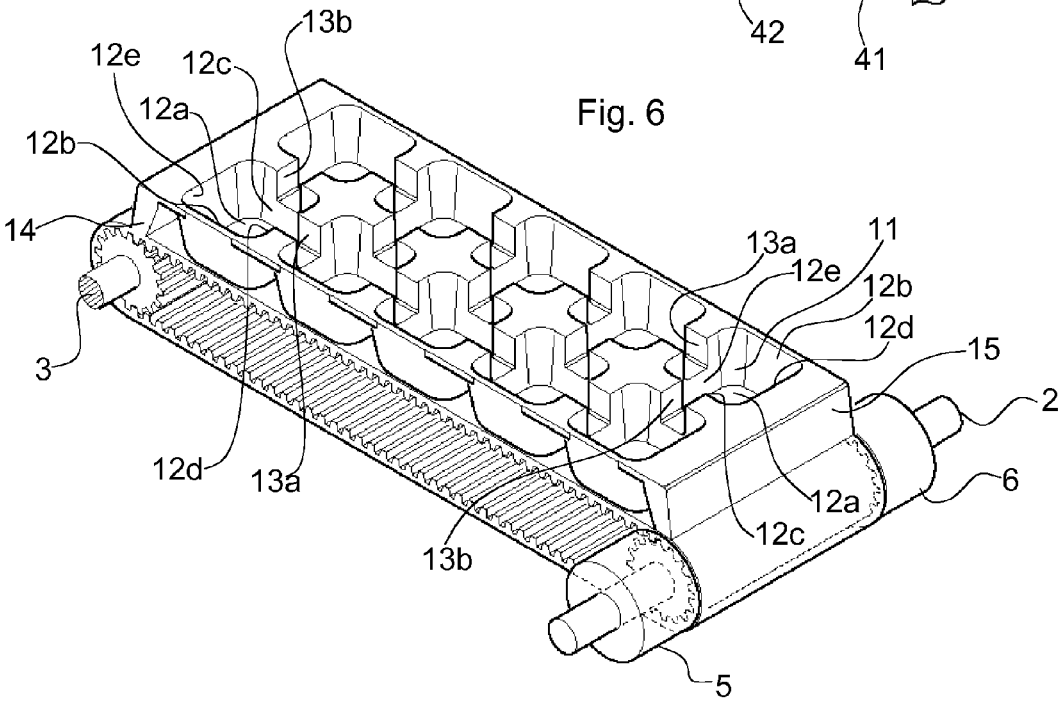
FIG. 6 is a schematic perspective view corresponding to FIG. 1 and illustrates certain parts of the ice maker shown in FIG. 1.

As best seen in FIGS. 3 and 6, each cavity 11 is defined by a bottom wall 12*a*, an outer side wall 12*b*, an inner side wall 12*c*, a front wall 12*d* and a rear wall 12*e*, in regard of the direction of movement of the conveyor belt 1. Longitudinal communicating channels 13*a* are arranged in the respective front 12*d* and rear 12*e* walls of adjacent cavities 11. Lateral communication channels 13*b* are arranged in respective side walls 12*b*, 12*c* of adjacent cavities 11. By this means water supplied to one cavity 11 will be distributed to all ten cavities 11 in the mould 10 via the longitudinal 13*a* and lateral 13*b* communication channels.

The mould 10 further comprises a front fixation portion 15 and a rear fixation portion 14, which are fixed to the conveyor belt 1. The fixation portions 15, 14 are formed integral with the rest of the mould 10. The front fixation portion 15 extends from an, in FIG. 6, upper plane of the mould 10, which plane is defined by the edges of the cavity walls 12*b-e* being distal from the cavity bottoms 12*a*, forwardly and downwardly to the conveyor belt 1. The rear fixation portion 14 extends in a corresponding manner rearward and downward from the upper plane of the mould to the conveyor belt 1. The front 15 and rear 14 fixation portions extend laterally over the entire width of the mould 10 and the conveyor belt 1. The front 15 and rear 14 fixation portions as well as the outer surfaces of the cavity bottom walls 12*a* are fixed to the conveyor belt by means of a silicone curing process. However, the fixation portions and the bottoms walls may also be fixed to the conveyor belt by other means such as heat fusion or adhesives.

The shafts 2, 3, the conveyor belt 1 and the mould 10 are arranged in a housing 20. The housing is essentially hermetically sealed from the surrounding, except at an air intake 21 and an air and ice outlet 22. A ventilator 23 (se FIG. 3) is arranged at the air inlet 21 for creating a forced flow of cool air inside the housing 20. A water conduit 24 having a supply orifice 25 is arranged in the housing 20. The supply orifice 25 is positioned at a comparatively small distance above a centrally positioned mould cavity 11, when the conveyor belt is in the initial position shown in FIG. 3. A temperature sensor 26 for determining when the water in the mould cavities has been transformed into ice, is arranged above the mould 10. At the embodiment shown, the temperature sensor measures the temperature of the air in the housing 20. The time required for full transformation of water in the mould into ice may be calculated staring out from the temperature measured by the sensor 26, the known amount of water received in the mould 10 and empirical data stored in the control unit. Instead of an air temperature sensor, an IR-sensor directly measuring the temperature of the water and ice may be utilized. A mould position determining sensor 27 is arranged in the housing 20 in proximity to the front fixation portion 13 of the mould, when the mould is in its initial position illustrated in FIG. 3. The mould position determining sensor is constituted of IR-sensor which cooperates with a reflector (not shown) arranged at the opposite side of the conveyor. The IR-sensor may be e.g. replaced by other types of optical sensors or by a micro-switch.

The housing further comprises a curved upper and front wall 28. The curved portion of this wall 28 is positioned at a predetermined distance above and in front of the first shaft 2 and the splined roller 4, as will be explained further below.

The ice maker is arranged in a freezer compartment of a refrigerator cabinet (not shown). The refrigerator cabinet comprises a freezer door 30. An ice collecting and storage container 31 is arranged at the inside of the freezer door 30. The ice maker is positioned in the freezer compartment such that the splined roller 4 at least partially, the curved portion of the wall 28 and the air and ice outlet 22 are arranged vertically above the container 31.

The exemplifying ice maker described above may suitably be used for batchwise production of pieces of ice. Such batchwise production will now be explained with reference to FIGS. 3-5. The initial position of the conveyor belt 1 and the mould 10 is represented in FIG. 3. In this position all mould cavities 11 are facing upwards. The production of ice is initiated by opening a water supply valve (not shown) which is controlled by the control unit (not shown). Water is then supplied through the water conduit 24 to the mould cavity positioned immediately below the supply orifice 25. The supplied water is distributed to all mould cavities 11 in the mould by means of the communicating channels 13*a*, 13*b* arranged between adjacent cavities. When the water level in the cavities 11 reaches a predetermined value, which corresponds to a suitable water level for forming the desired pieces of ice, the water supply valve is closed. In practice, the valve is closed by the control unit after a predetermined opening time, which opening time is based on empiric data and stored in the control unit. Since all cavities are filled simultaneously the amount of water to be supplied is considerable larger than if only one or a few cavities were to be filled. Thereby, the required accuracy of the correct amount of water to be supplied is reduced. This constitutes an important advantage since high accuracy water supply controlling means, such as, water supply valves, control units and if used, water level sensors are comparatively expensive. Further more, the lower accuracy required at large water supply amounts reduces the risk of that too much or too little water is supplied. This would otherwise result in overflow with resulting unwanted ice formation outside of the mould or in that the pieces of ice are formed with dimensions that are essentially smaller than desired.

When the supply of water is completed, the conveyor belt and the mould are maintained in the initial position until the entire amount of water supplied to the mould has been transformed into ice. As indicated above the time required for full transformation into ice may be calculated from empiric data stored in the control unit and the measured temperature of the air. When the water is completely frozen into ice, the control unit actuates the motor 8 to drive the pulley 7.

Alternatively, the actuation of the motor 8 may be done upon demand, manually by a user e.g. by pushing a button at the outside of the refrigerator. However, the control unit should then ensure that such manual actuation may not be done before the water has been fully transformed into ice.

Figure 2:
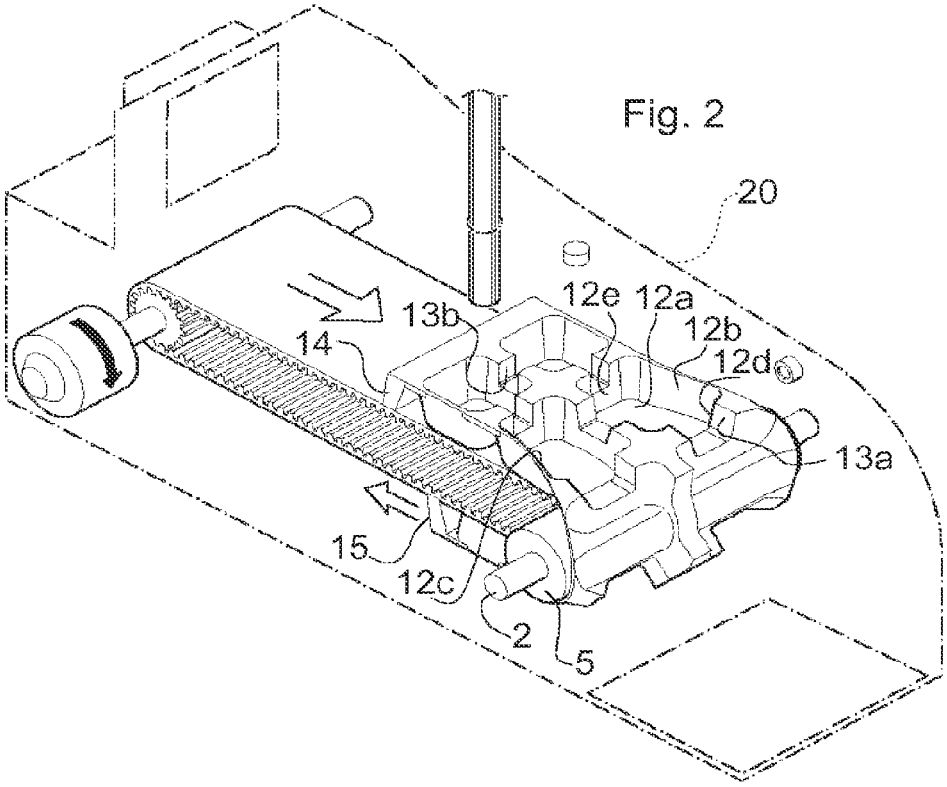
FIG. 2 is a schematic perspective view corresponding to FIG. 1 at which the ice maker is showed in a second position.
Figure 4:
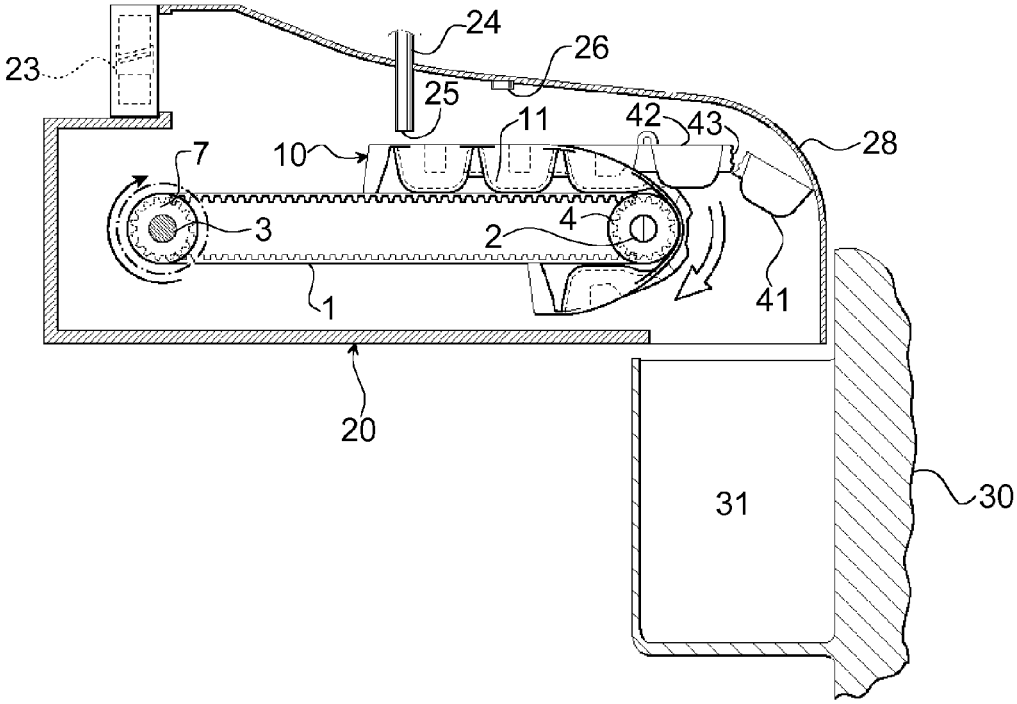

The pulley drives the conveyor belt to move clockwise as seen in the figures. As is best illustrated in FIGS. 2 and 4, the elastic material of the mould 10 is substantially deformed as the mould passes over the first shaft 2 with the splined roller 4. The front fixation portion 15 fixed to the conveyor belt 1, in front of the cavities 11, will cause the front wall 12*d* of each cavity 11 to be stretched away from the respective rear wall 12*e*. Further more, each outer side wall 12*b* will be stretched away from the respective inner side wall 12*c*. At this deformation of the outer side walls 12*b*, the material of these side walls will be supported by the respective side roller 5, 6 (see FIG. 2). This prevents the mould material from being squeezed between the roller 4 and the conveyor belt 1 and to otherwise cause malfunction and excessive wear of the conveyor belt (1). The inner side walls 12*c* are simultaneously compressed in the direction towards the bottom wall 12*a*. Each bottom wall 12*a* is further gradually bent such that it assumes a curvature corresponding to the diameter of the splined roller 4. By this means all walls 12*a-e* defining each cavity 11 is substantially deformed by elastic stretching, elastic compression and/or elastic bending or flexing of the material forming the walls. This deformation of the cavity walls 12*a-e* results in that the piece of ice formed in each cavity is released from the respective cavity as the cavity passes over the splined roller 4.

As is best seen in FIG. 4, a preceding piece of ice 41 which is released from the cavity walls 12*a-e*, is still linked to an subsequent adjacent piece of ice 42 by means if an ice bridge 43 formed by ice in the longitudinal communicating channel 13*a* between the corresponding two mould cavities 11. The preceding piece of ice 41 will thus remain at essentially the same horizontal level as the subsequent piece of ice 42, when its mould cavity is drawn downwards along the periphery of the roller 4. Thereby the separation of the preceding piece of ice 41 from its mould cavity is enhanced even further. The ice bridges 43 formed by the longitudinal channels 13*a* thus prevent pieces of ice to remain in any contact with the mould, also at very small portions thereof. Hereby it is readily achieved that the pieces of ice do not stick to mould when the mould cavity passes over the shaft 4.

The ice bridges 43 result in that the preceding pieces of ice do not immediately fall down into the collecting container 31 but instead continue essentially horizontally forward. However, the preceding piece of ice 41 impacts the curved portion of the housing wall 28. At this impact the ice bridge between the piece of ice 41 and the subsequent piece of ice 42 is broken and the preceding piece of ice 41 will thereafter fall down into the collecting container 31.

Figure 5:
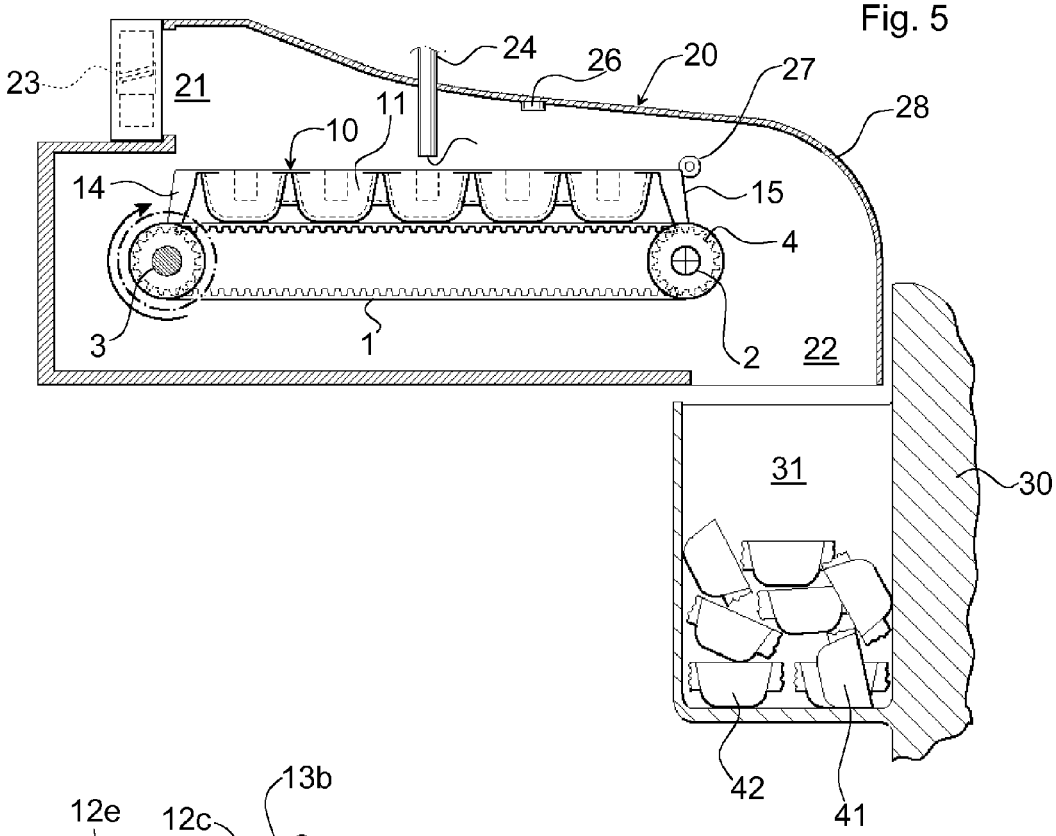

The motor 8 is driven continuously until the mould position detector 27 detects that the mould has returned to its initial position as indicated in FIG. 5. During this continued drive of the motor 8 and the conveyor belt 1, the release and ice bridge breaking operations are repeated consecutively for all pairs of pieces of ice in the mould and the harvested pieces of ice are collected in the container 31. When the mould has returned to its initial position, the entire ice production and harvesting cycle described above may be repeated.

An advantage of the ice maker and method described above is that the area where all the pieces of ice are released from the mould and delivered from the ice maker is very well defined and comparatively small. By this means the collecting container may be given space saving dimensions. Further more, the portion of the ice maker at which pieces of ice are delivered may be arranged such that only this portion protrudes into a door of the refrigerator cabinet. This essentially facilitates the possibility to accomplish dispensing of pieces of ice through the door.

In FIGS. 7-10, an ice maker according to an alternative embodiment is schematically illustrated. The ice maker according to this embodiment comprises a first 102 and a second 103 shaft. A first roller 104 and a second roller 107 are fixed to the first and second shafts respectively. Both rollers 104, 107 comprises a central portion 104a having afirst diameter and two side portions 104*b* having a second diameter, which is larger than the first diameter. A number of radial indentations 104*c* are arranged around each side portion 104*b*. The second shaft 103 is connected to an electrical motor (not shown).

An integrally formed endless conveyor 100 is arranged around the first 104 and second 107 roller. The conveyor 100 comprises a central mould portion 110 forming a number of mould cavities 111*a*, 111*b* arranged one after the other in a single column around the entire length of the endless conveyor 100. Each mould cavity 111*a*, 111*b* is defined by a bottom wall 112*a*, opposing side walls 112*b*, 112*c* a front wall 112*d* and a rear wall 112*e*, in regard of the direction of movement of the conveyor 100. The mould cavities comprise a first set of mould cavities 111*a*. In the example shown in FIG. 7, the first set of mould cavities 111*a* comprises the upper four mould cavities 111*a*, which are arranged between the first 104 and second 107 rollers. Longitudinal communication channels 113*a* are arranged in the respective front 112*d* and rear 112*e* walls between the mould cavities 111*a* of the first set of mould cavities. The remaining cavities 111*b* which do not form part of the first set of mould cavities are individual and separate cavities which are not joined by any longitudinal channels.

Figure 7:
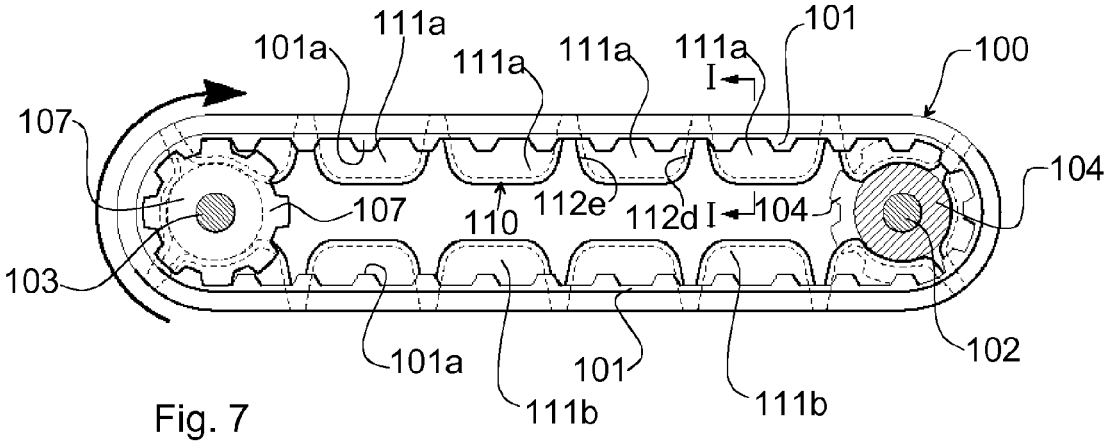
FIG. 7 is a side view of an ice maker according to a second embodiment of the invention.
Figure 8A:
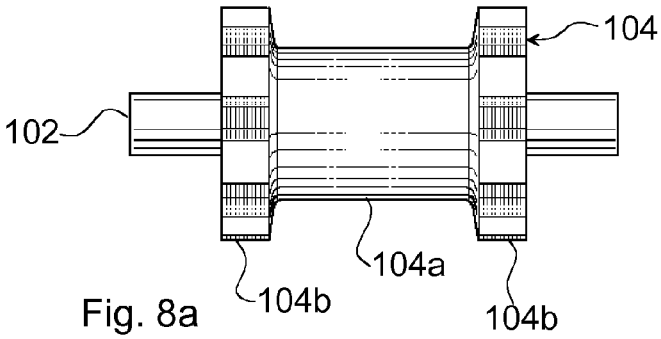
FIG. 8*a* is a front view and 8*b* a side view of a detail of the ice maker shown in FIG. 7
Figure 8B:
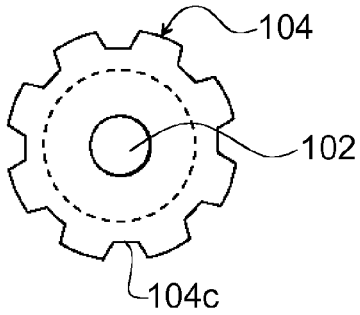
Figure 9:
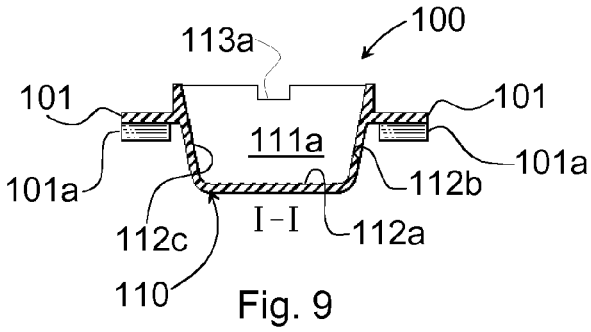
FIG. 9 is a section along line I-I in FIG. 7.

The central mould portion 110 is formed of silicone. A conveyor belt portion 101 extends sideways outwardly from an upper region of each side wall 112*b*, 112*c*. The two conveyor belt portions 101 form an outwardly extending flange which extends longitudinally around the entire length of the conveyor 100. A number teeth 101*a* or cogs protrude from each flange in a direction toward each other as seen in FIG. 7. The teeth 101*a* are formed such as to mate with the indentations 104*c* formed in the side portions 104 of the rollers 102, 104 for achieving a secure, smooth and slip-free drive of the conveyor 100, when the second shaft 103 is driven by the motor.

The conveyor 100 and the first roller 104 are arranged such that the distance between the conveyor belt portions 101 and the outer surface of the bottom walls 112*a* exceeds the distance between the conveyor belt portions 101 and the outer cylindrical surface of the first rollers central portion 104*a*.

The mould portion 110 and the conveyor belt portions 101 are formed integrally in a single manufacturing step e.g. by injection moulding. Silicone may be used for forming both the mould portion 110 and the conveyor belt portions 101. Preferably the conveyor belt portions are then reinforced by means of thin reinforcing cords having high rigidity in the longitudinal direction. Such cords may be positioned in the injection moulding mould before the silicone material is injected.

The embodiment shown in FIGS. 7-10 may advantageously be used both for batchwise and for semi-continuous or stepwise manufacturing and harvesting of pieces of ice. For batchwise manufacturing and harvesting, the first set of mould cavities 111*a* are used as described above with reference to FIG. 1-6. Batchwise operation is hence carried out for approximately half a revolution of the conveyor. During such batchwise operation the longitudinal communication channels 113*b* ensure that water supplied to one cavity of the first set of mould cavities is distributed also to the other cavities 111*a* of the first set of cavities.

For semi-continuous or stepwise manufacturing, the remaining cavities 111*b*, not forming part of the first set of mould cavities, are used. Water is supplied to a remaining mould cavity 111*b* by means of a feed pipe (not shown) which is positioned above the conveyor 100 in proximity to the second shaft 103. The second shaft 103 is driven by the motor at low speed, such that the water supplied to the remaining cavity will be completely transformed into ice when this cavity reaches the first shaft 102.

Figure 10:
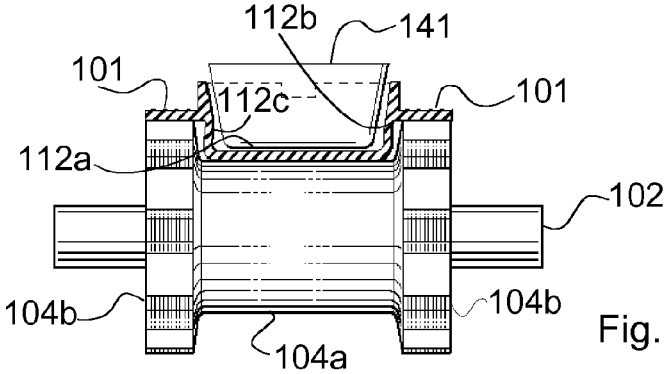
FIG. 10 is a front view of some details of the ice maker shown in FIG. 7.

When the remaining cavity 111*b* reaches the first roller 104, the outer side of the front wall 112*d* and the bottom wall 112*a* will contact the cylindrical surface of the first roller's 104 central portion 104*a*. During the continuing movement, the bottom wall 112*a* is pressed radially outwards by the central portion 104*a* of the first roller 104. As is best seen in FIGS. 7 and 10 this results in that the front wall 112*d*, side walls 112*b*, 112*c*, and the rear wall 112*e* are gradually compressed as the cavity travels along the first roller 104. During passage of the first roller, the bottom wall 112*a* is also gradually bent such that it assumes a curvature corresponding to the diameter of the first roller's central portion 104*a*. By this means the piece of ice 141 is lifted relative to the front 112*d*, rear 112*e* and side 112*b*, 112*c* walls. The piece of ice 141 is thereby released from the cavity walls and will fall down into a collecting container (not shown) which is placed beneath the first roller 104. The cavity is thereafter transitioned to a downwardly facing position and moved further towards the second roller 107. During such movement, the first set of mould cavities will reach the position shown in FIG. 7. At this instance the conveyor is stopped for supply to and freezing of water in the first set of mould cavities. During harvest of ice in the first set of mould cavities the pieces of ice in the first set of mould cavities are release from the respective mould cavities in the same manner as described above for the remaining mould cavities.

During passage of the second roller 107, the remaining cavity 111*b* will again be transitioned back to the upwardly facing position and is thereafter once more supplied with water. By repeatedly supplying water alternate to the first set of cavities 111*a* and to each remaining cavity 111*b* which has recently passed the second roller 107 a combination of batchwise and semi-continuous or stepwise manufacturing and harvesting of pieces of ice is achieved for each revolution of the conveyor.

In an embodiment which is not shown, the mould cavities may comprise a first set of mould cavities and a second set of mould cavities. Longitudinal channels are arranged between cavities in each set of cavities, but not between the two sets of mould cavities. By this means two batches of pieces of ice may be manufactured and harvested during one revolution of the conveyor. The mould cavities may further comprise any desirable number of sets of mould cavities, wherein longitudinal communication channels are arranged between mould cavities within each set, but wherein the sets of mould cavities are separated from each other. A set of mould cavities communicating with each other may not comprise more cavities than that all cavities within the set may be arranged upwardly simultaneously. Otherwise water supplied to the set of cavities will fall from the cavity or cavities which are not arranged upwardly during supply of water.

In a further alternative, the motor and the conveyor may be stepwise driven upon manual activation e.g. by pushing an exteriorly arranged push button. At each step, the conveyor is driven a distance which corresponds to the movement of single or a row of pieces of ice to at least partially pass over the front roller, where the cavity walls are deformed. By such an arrangement the production and harvesting of ice on demand is readily accomplished. Such ice on demand may either be accomplished with the ice maker illustrated in the FIGS. 1-6 or with the embodiment illustrated in FIGS. 7-10, where the mould extends along the entire circumference of the conveyor belt.

Above, different exemplifying embodiments of the invention has been described. It is however readily understood that the invention is not limited to these embodiments. Instead the invention may be freely varied within the scope of the appending claims. For instance, different features of the embodiments shown and described above may be combined. Further more the number and arrangements of mould cavities may be varied freely as desired. For example the mould may comprise one single cavity a single column with any number of cavities arranged one after the other or any suitable matrix of cavities arranged in any number of columns and rows. Instead of being operated automatically by means of a motor and a control unit the ice maker may also be manual or semi automatic. The motor may e.g. be replaced by a manually operated crank or knob and the water supply conduit may be dispensed with for instead supplying water manually by pouring water from a jug or the like into cavities facing upwards.

What is claimed is:

1. An ice maker comprising:

a mould forming a number of consecutive mould cavities for receiving water and forming a respective piece of ice, each mold cavity including a front wall, a rear wall, an inner side wall, an outer side wall, and a bottom portion, the number of mould cavities being arranged in at least one column defining a longitudinal direction;

a first shaft and a second shaft;

an endless conveyor , which is arranged to convey the mould in the longitudinal direction around at least the first shaft; and a drive means connected to at least the first shaft or the second shaft for driving the endless conveyor, wherein the mould is formed of an elastic material and arranged to be elastically deformed as the mould passes around the first shaft, characterized by longitudinal communication channels which are arranged between at least some of the consecutive mould cavities within the at least one column which allow water to flow between the at least some of the consecutive mould cavities within the at least one column, and the mould further comprising a front fixation portion located at and fixed to the front of the at least one column, the front fixation portion extending from an upper plane of the mould that is distal with respect to the bottom portions of the mold cavities and the front fixation portion extending downwardly from said upper plane to be further fixed to the endless conveyor so that the elastic material of the mould is elastically deformed as the front fixation portion passes around the first shaft to cause the front wall of each mold cavity to be stretched away from the respective rear wall, the outer side wall of each mold cavity to be stretched away from the respective inner side wall, and the bottom portion to assume a curvature to thereby release the piece of ice from each respective cavity.

2. An ice maker according to claim 1, wherein the mould comprises at least two columns of mould cavities , and wherein the mould includes lateral communication channels that are arranged generally perpendicular to the longitudinal direction, between at least some of adjacent mould cavities in respective columns.

3. An ice maker according to claim 1, wherein the first shaft, the endless conveyor and the mould are arranged to compress the walls of the mould cavity elastically as the mould cavity passes around the first shaft.

4. An ice maker according to claim 1, wherein the first shaft, the endless conveyor and the mould are arranged to stretch the walls of the mould cavity as the mould cavity passes around the first shaft.

5. An ice maker according to claim 1, wherein the endless conveyor comprises a conveyor belt, the mould being fixed to the conveyor belt.

6. An ice maker according to claim 5, wherein the conveyor belt includes a conveyor belt portion and the mould includes a mould portion , the conveyor belt portion and the mold portion being formed as an integral unit.

7. An ice maker according to claim 5, wherein the mould extends over approximately half of the circumferential length of the conveyor belt.

8. An ice maker according to claim 2, wherein the longitudinal communication channels and the lateral communication channels are arranged between all the mould cavities of the mould.

9. An ice maker according to claim 5, wherein the mould extends over approximately the entire circumferential length of the conveyor belt and wherein the longitudinal communication channels are arranged between consecutive mould cavities comprising a first set of mould cavities, the first set of mould cavities being arranged in at least one column and extending over approximately a first half of the circumferential length of the conveyor belt.

10. An ice maker according to claim 9, wherein longitudinal communication channels are arranged between consecutive mould cavities comprising a second set of mould cavities, the second set of mould cavities being arranged in at least one column and extending over approximately a second half of the circumferential length of the conveyor belt, the longitudinal communication channels arranged between consecutive mould cavities comprising the first set of mould cavities and the longitudinal communication channels arranged between consecutive mould cavities comprising the second set of mould cavities being isolated from one another so that the first set of mould cavities do not communicate with the second set of mould cavities.

11. An ice maker according to claim 1, comprising an ice breaking means arranged to break ice bridges between consecutive pieces of ice following the release of the pieces of ice from the corresponding mould cavities as the corresponding mould cavities pass around the first shaft.

12. An ice maker according to claim 1, comprising a housing inside of which the endless conveyor, the first shaft, the second shaft and the mould are arranged.

13. An ice maker according to claim 11, comprising a housing inside of which the endless conveyor, the first shaft, the second shaft and the mould are arranged, wherein the ice breaking means comprises a wall of the housing, which is arranged at a predetermined distance from the first shaft.

14. An ice maker according to claim 12, comprising a means for providing cool air into the housing.

15. An ice maker according to claim 1, wherein the endless conveyor comprises a conveyor belt formed of a first material and the mould is formed of a second material, wherein the first material is more rigid than the second material.

16. An ice maker according to claim 1, wherein the drive means comprises an electric motor.

17. An ice maker according to claim 1, comprising a refrigerator cabinet with a door, wherein the first shaft is arranged in proximity to or inside the door, when the door is in a closed position.

18. A method of fabricating pieces of ice comprising the steps of:

supplying water to a number of mould cavities, each mould cavity including a front wall, a rear wall, an inner side wall, an outer side wall, and a bottom portion, formed by a mould of an elastic material, the mould being conveyed by an endless conveyor around at least a first shaft, the number of mould cavities being arranged in at least one column defining a longitudinal direction, wherein longitudinal communication channels are arranged between consecutive mould cavities within a column which allow water to flow between the consecutive mould cavities within the column and the mould further comprising a front fixation portion located at and fixed to the front of the at least one column, the front fixation portion extending from an upper plane of the mould that is distal with respect to the bottom portions of the mold cavities and the front fixation portion extending downwardly from said upper plane to be further fixed to the endless conveyor;

freezing the water in said number of mould cavities into a corresponding number of pieces of ice;

driving the conveyor around at least the first shaft, and at least partially separating the mould from the pieces of ice by elastically deforming the elastic material of the mould at the corresponding number of mould cavities when the corresponding mould cavities pass over the first shaft by causing the front wall of each mold cavity to be stretched away from the respective rear wall, the outer side wall of each mold cavity to be stretched away from the respective inner side wall, and the bottom portion to assume a curvature to thereby release the piece of ice from each respective cavity.

* * * * *

UNITED STATES PATENT AND TRADEMARK OFFICE

CERTIFICATE OF CORRECTION

PATENT NO. : 8,904,816 B2
APPLICATION NO. : 13/146455
DATED : December 9, 2014
INVENTOR(S) : Anders Bergqvist et al.

It is certified that error appears in the above-identified patent and that said Letters Patent is hereby corrected as shown below:

In the Specification,

Column 8, line 25; Please delete “se” and add -- see --

Column 10, line 46; Please delete “afirst” and add -- a first --

Signed and Sealed this
Fifth Day of May, 2015

Michelle K. Lee

Michelle K. Lee
*Director of the United States Patent and Trademark Office*